US010571221B2

(12) United States Patent
DeSantis

(10) Patent No.: US 10,571,221 B2
(45) Date of Patent: Feb. 25, 2020

(54) HOLSTER

(71) Applicant: Gunhide Properties, LLC, Amityville, NY (US)

(72) Inventor: Gene DeSantis, Brookville, NY (US)

(73) Assignee: GUNHIDE PROPERTIES, LLC, Amityville, NY (US)

( * ) Notice: Subject to any disclaimer, the term of this patent is extended or adjusted under 35 U.S.C. 154(b) by 0 days.

(21) Appl. No.: 16/252,646

(22) Filed: Jan. 20, 2019

(65) Prior Publication Data

US 2019/0226800 A1 Jul. 25, 2019

Related U.S. Application Data

(60) Provisional application No. 62/620,413, filed on Jan. 22, 2018.

(51) Int. Cl.
*F41C 33/04* (2006.01)
*F41C 33/02* (2006.01)

(52) U.S. Cl.
CPC ..... *F41C 33/041* (2013.01); *F41C 33/048* (2013.01)

(58) Field of Classification Search
CPC ..... F41C 33/02; F41C 33/04; F41C 33/0209; F41C 33/041; F41C 33/048
See application file for complete search history.

(56) References Cited

U.S. PATENT DOCUMENTS 2,049,293 A * 7/1936 Fink ..... A45F 5/021 224/675
2,109,232 A * 2/1938 Hoyt ..... A45F 3/14 224/193
2,213,472 A * 9/1940 Myres ..... F41C 33/0245 224/243
4,577,787 A * 3/1986 Hersey ..... F41C 33/0236 224/192
4,718,585 A * 1/1988 Atkins, Sr. ..... F41C 33/0227 224/238
4,785,983 A * 11/1988 DeSantis ..... F41C 33/0227 224/587
6,092,703 A * 7/2000 Johnson ..... F41C 33/041 224/198
8,371,487 B1 * 2/2013 Plappert ..... F41C 33/0236 224/193

(Continued)

*Primary Examiner* — Justin M Larson
(74) *Attorney, Agent, or Firm* — Bennet K. Langlotz; Langlotz Patent & Trademark Works, LLC

(57) ABSTRACT

Holsters have a body defining a pistol receptacle, the body having a medially-facing first major surface configured to face toward a wearer, a laterally-facing second major surface configured to face away from the wearer, a first belt passage associated with the first major surface and adapted to receive a wearer's belt with a portion of the belt between a major portion of the body, a belt loop receptacle associated with the second major surface, a belt loop element configured to be removably received by the belt loop receptacle, the belt loop element including a fastener having a fastened condition and an unfastened condition, and the fastener adapted to secure the belt loop element in a closed loop when in the fastened condition to encompass a wearer's belt with the body between the belt and the wearer, and to enable insertion and removal of a belt when in an unfastened condition.

13 Claims, 6 Drawing Sheets

(56) References Cited

U.S. PATENT DOCUMENTS

| | | | | |
|---|---|---|---|---|
| D792,088 | S * | 7/2017 | Laemmlen | F41C 33/048<br>D3/222 |
| 2007/0095869 | A1* | 5/2007 | Gallagher | F41C 33/041<br>224/192 |
| 2012/0187164 | A1* | 7/2012 | Looper | F41C 33/0209<br>224/243 |
| 2017/0059275 | A1* | 3/2017 | Cohen | B26B 29/025 |
| 2019/0226800 | A1* | 7/2019 | DeSantis | F41C 33/041 |

* cited by examiner

HOLSTER

CROSS-REFERENCE TO RELATED APPLICATION

This application claims the benefit of U.S. Provisional Patent Application No. 62,620,413 filed on Jan. 22, 2018, entitled "Osprey," which is hereby incorporated by reference in its entirety for all that is taught and disclosed therein.

FIELD OF THE INVENTION

The present invention relates to firearms, and more particularly to a holster that is convertible between inside the waistband carry and outside the waistband carry.

BACKGROUND OF THE INVENTION

A holster is a device used to hold or restrict the undesired movement of a pistol, most commonly in a location where it can be easily withdrawn for immediate use. Holsters are generally designed to offer protection to the pistol, secure its retention, and provide ready access to it. The need for ready access is often at odds with the need for security and protection. Choosing the right balance can be very important, especially in the case of a defensive weapon holster, where failure to access the weapon quickly or damage or loss of the weapon because of insufficient retention or protection could result in serious injury or death to the user.

Holsters are generally attached to a person's belt or waistband or clipped to another article of clothing. Inside the Waistband (IWB) holsters are designed to be carried inside of a wearer's pants. Outside the Waistband (OWB) holsters are designed to be carried outside of the waistband. IWB holsters makes the enclosed firearm easier to conceal, but has the deficiencies of being making the firearm potentially more difficult to draw and being uncomfortable and requiring the user to wear compatible pants. OWB holsters are potentially more comfortable to wear and make it easy to draw the firearm. However, OWB holsters have the disadvantages of being more visible and requiring the user to wear a compatible belt. Furthermore, conventional IWB and OWB holsters are limited to only IWB or OWB carry. If the wearer wishes to change between the two methods of carry, the wearer must transfer his or her firearm to a different holster designed for that type of carry. The wearer is unable to adapt to changing circumstances where a different type of carry might be preferred unless the wearer always has two different types of holsters available.

Therefore, a need exists for a new and improved holster that converts between inside the waistband carry and outside the waistband carry. In this regard, the various embodiments of the present invention substantially fulfill at least some of these needs. In this respect, the holster according to the present invention substantially departs from the conventional concepts and designs of the prior art, and in doing so provides an apparatus primarily developed for the purpose of providing a holster that is convertible between inside the waistband carry and outside the waistband carry.

SUMMARY OF THE INVENTION

The present invention provides an improved holster, and overcomes the above-mentioned disadvantages and drawbacks of the prior art. As such, the general purpose of the present invention, which will be described subsequently in greater detail, is to provide an improved holster that has all the advantages of the prior art mentioned above.

To attain this, the preferred embodiment of the present invention essentially comprises a body defining a pistol receptacle, the body having a medially-facing first major surface configured to face toward a wearer and a laterally-facing second major surface configured to face away from the wearer, a first belt passage associated with the first major surface and adapted to receive a wearer's belt with a portion of the belt between a major portion of the body, a belt loop receptacle associated with the second major surface, a belt loop element configured to be removably received by the belt loop receptacle, the belt loop element including a fastener having a fastened condition and an unfastened condition, and the fastener adapted to secure the belt loop element in a closed loop when in the fastened condition to encompass a wearer's belt with the body between the belt and the wearer, and to enable insertion and removal of a belt when in an unfastened condition. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
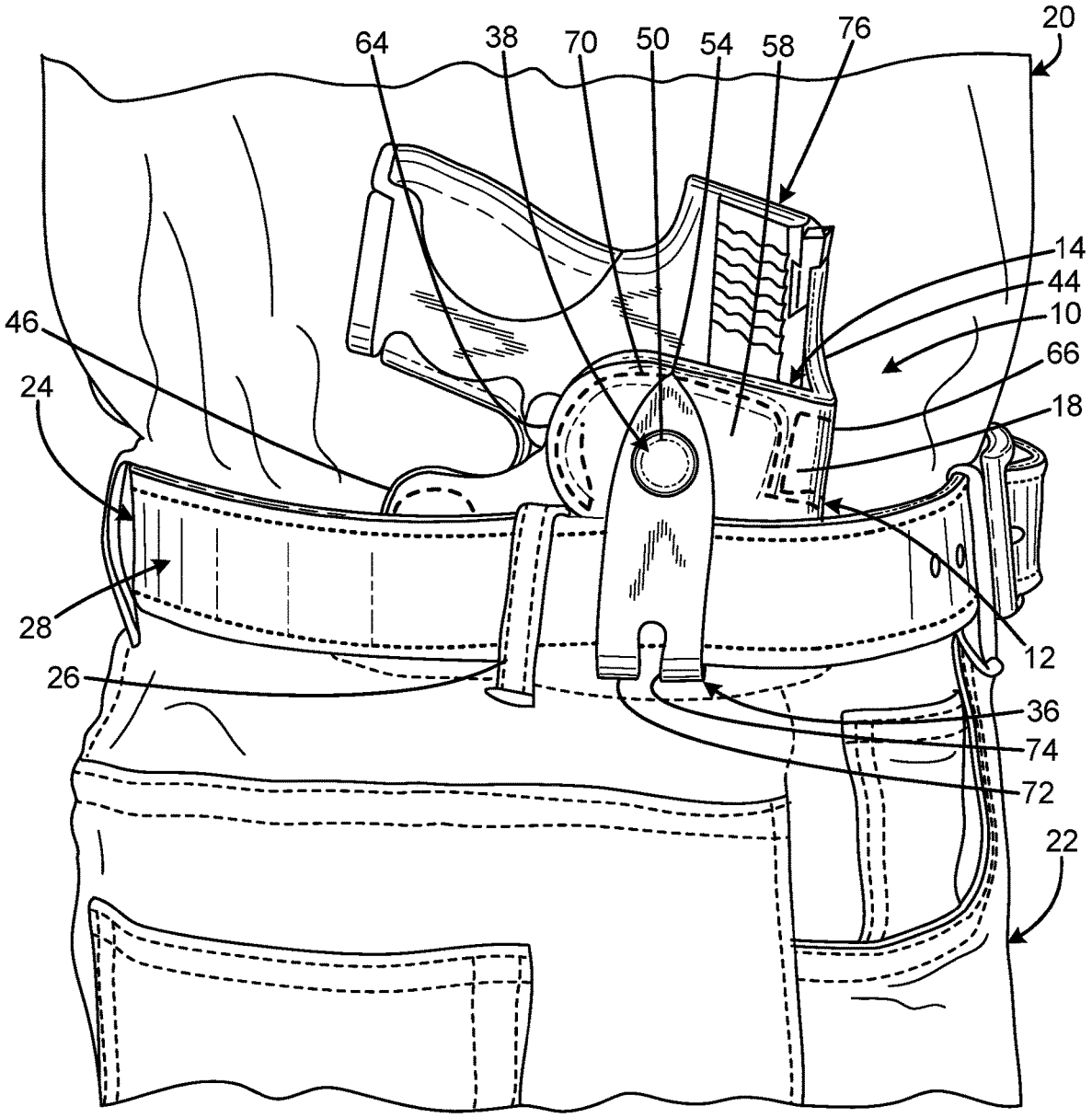
FIG. 1 is a right side view of the current embodiment of the holster constructed in accordance with the principles of the present invention. The holster is shown in use for inside the waistband carry.

An embodiment of the holster of the present invention is shown and generally designated by the reference numeral 10.

Figure 2:
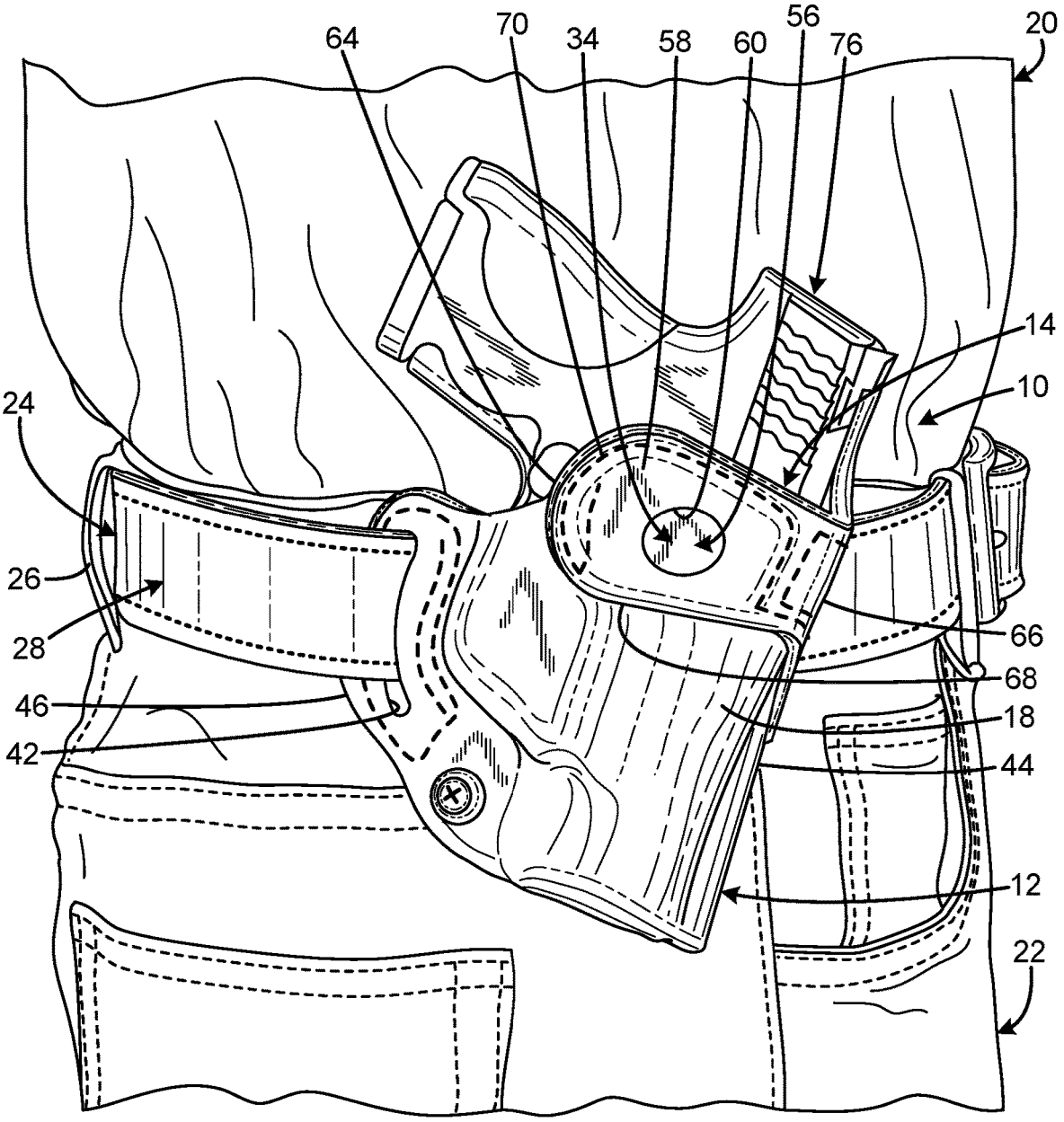
FIG. 2 is a right side view of the holster of FIG. 1. The holster is shown in use for outside the waistband carry.
Figure 3:
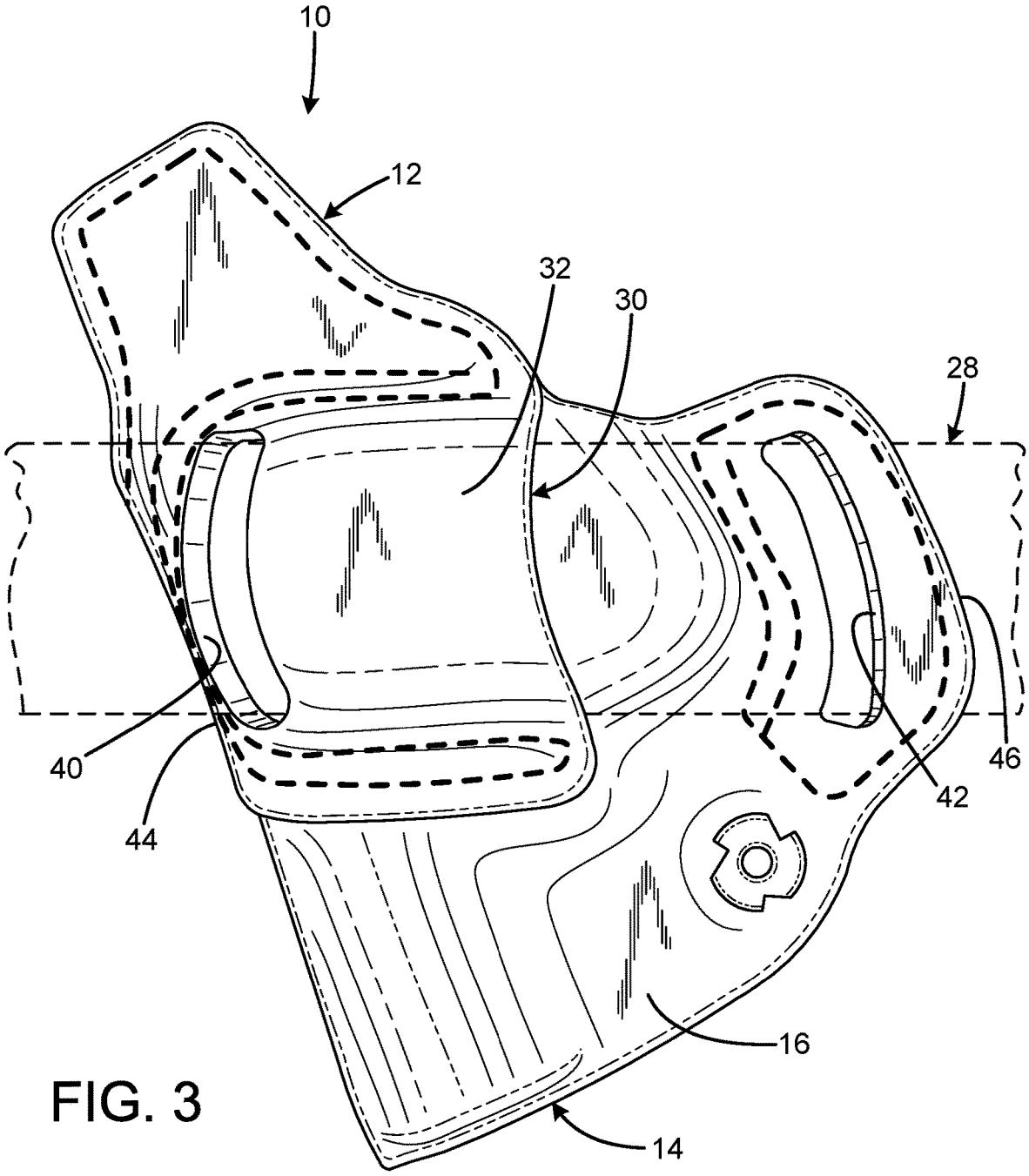
FIG. 3 is a left side view of the holster of FIG. 1 showing how a belt connects to the holster for outside the waistband carry.

FIGS. 1-3 illustrate the improved holster 10 of the present invention. More particularly, in FIG. 1 the holster 10 is depicted in use for Inside the Waistband (IWB) carry, and in FIG. 2 the holster is depicted in use for Outside the Waistband (OWB) carry. The holster 10 has a body 12 forming an upwardly-facing pistol receptacle 14 defined by a left panel 16 (visible in FIG. 3) and a right panel 18. The left panel is a medially-facing first major surface configured to face toward a wearer 20. The right panel is a laterally-facing second major surface configured to face away from the wearer. The wearer is shown wearing pants 22 having a waistband 24. The waistband includes belt loops 26 that receive a belt 28.

The left panel 16 of the holster 10 has a first belt passage associated with the left panel (first major surface) and adapted to receive the belt 28 of a wearer 20 with a portion of the belt between a major portion of the body 32. This is the configuration of the holster for OWB carry. The left panel includes a pair of first belt apertures 40, 42 that receive the belt of a wearer when the holster is configured for OWB carry. Each of the first belt apertures is proximate to one of a pair of opposed peripheral edges 44, 46 of the body.

The right panel 18 of the holster 10 has a belt loop receptacle 34 (visible in FIG. 2) associated with the right panel (second major surface). A belt loop element 36 is configured to be removably received by the belt loop receptacle. The belt loop element is present when the holster is configured for IWB carry (FIG. 1) and is optionally removed for OWB carry (FIG. 2). The belt loop element includes a fastener (snap 38) having a fastened condition and an unfastened condition. The fastener is adapted to secure the belt loop element in a closed loop when in the fastened condition to encompass the belt 28 of a wearer 20 with the body 12 between the belt and the wearer to enable IWB carry, and to enable insertion and removal of the belt from the belt loop element when the belt loop element is in an unfastened condition. The holster is anchored in position by the connection of the belt loop element and the belt, which prevents undesirable movement of the holster while a pistol 76 received in the holster is drawn.

To holster a pistol 76 in the holster 10 in both IWB carry and OWB carry, the muzzle (not visible) is inserted into the upwardly-facing pistol receptacle 14 defined between the left panel 16 and the right panel 18. The holster 10 is illustrated in a configuration for being worn on the right hip of the wearer 20, but can also be worn on the left hip of the wearer. If desired, the left and right panels and their associated features can be reversed to create a mirror image of the holster to facilitate left-handed draw when the holster is worn on the left hip of the wearer.

Figure 4:
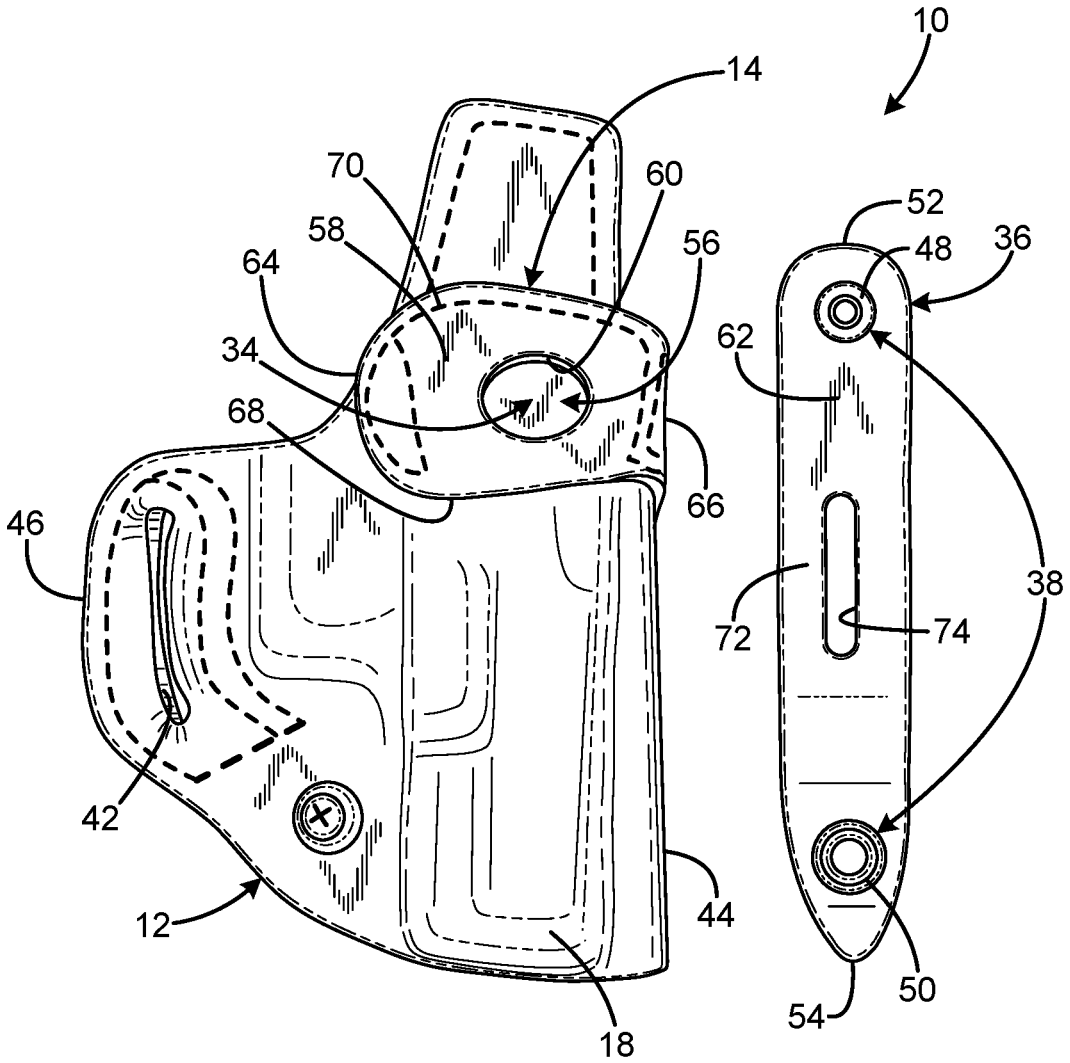
FIG. 4 is a right side view of the holster of FIG. 1 with the belt loop element separated from the belt loop receptacle.
Figure 5:
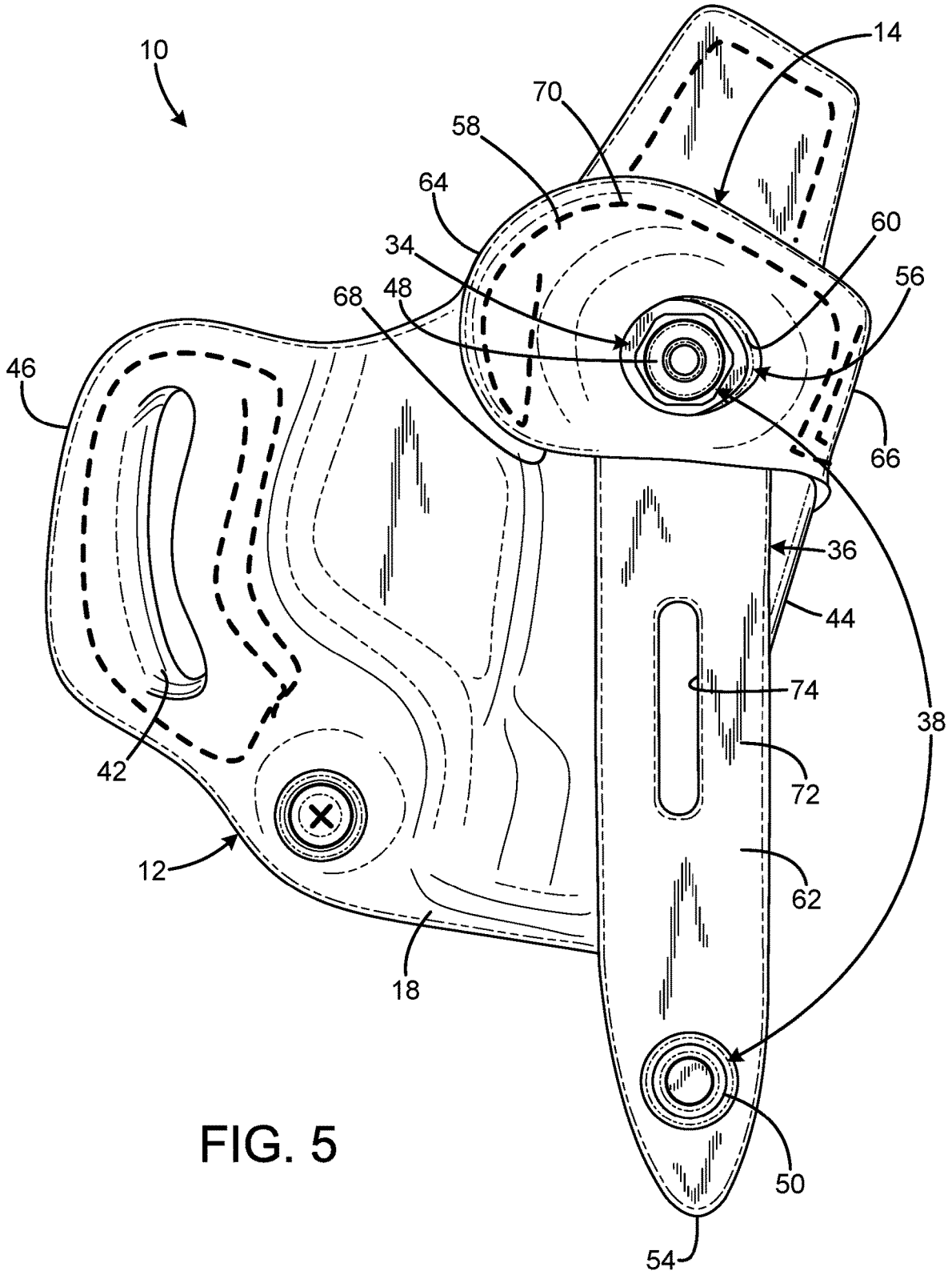
FIG. 5 is a right side view of the holster of FIG. 1 with the belt loop element in the unfastened condition installed in the belt loop receptacle.
Figure 6:
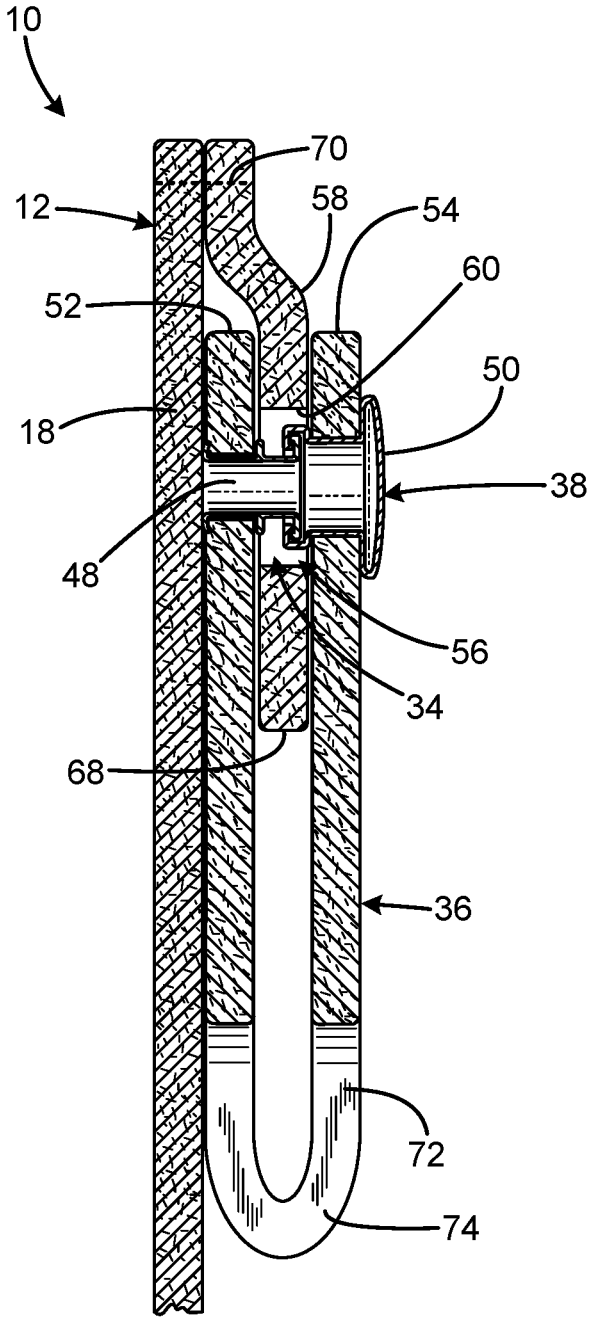
FIG. 6 is a rear sectional enlarged fragmentary view of the holster of FIG. 1 with the belt loop element in the fastened condition installed in the belt loop receptacle.

FIGS. 4-6 illustrate the improved holster 10 of the present invention. More particularly, the fastener (snap 38) has two opposed portions 48, 50 selectably connectable to each other. The belt loop element 36 is an elongated body, and the two fastener portions are on opposed ends 52, 54 of the belt loop element. The belt loop receptacle 34 includes a pocket 56 in which one end of the belt loop element is inserted. The pocket is defined by an outer layer/panel 58 overlaying and attached to the right panel 18 (the second major surface) defining a belt loop element fastener aperture 60. The outer layer/panel is attached to the right panel at opposed side edges 64, 66 of the outer layer/panel. The outer layer/panel is detached from the right panel at a lower edge 68 to provide access to the pocket such that the outer layer/panel is attached at its entire periphery except for the lower edge by stitching 70. In the current embodiment, the outer layer/panel formed by a portion of the major portion of the body 32 that defines the first belt passage 30 that wraps around the opposed peripheral edge 44 of the holster from the left panel 16 to the right panel.

The belt loop element fastener aperture 60 is configured to enable the opposed fastener portions 48, 50 to connect to each other via the belt loop element fastener aperture. The fastener includes a protruding portion (portion 48) protruding above surface 62 of the belt loop element 36. The protruding fastener portion resists removal of the belt loop element from the pocket 56 when the protruding fastener portion is received in the belt loop element fastener aperture. However, the protruding fastener portion and opposed end 52 of the belt loop element can be removed from the pocket without the use of tools by placing the fastener (snap 38) in the unfastened condition and applying a manual downward force to the opposed end 54 of the belt loop element. The protruding fastener portion and opposed end 42 of the belt loop element can be returned to the pocket without the use of tools by inserting the opposed end 52 of the belt loop element under the lower edge 68 of the outer layer/panel 58 and applying a manual upward force to the opposed end 52 of the belt loop element until the protruding fastener portion protrudes from the pocket through belt loop fastener aperture 60. A middle portion 72 of the belt loop element defines a slit 74 to prevent the leather at the fold from splitting when the belt loop element forms a closed loop when the fastener (snap 38) is in the fastened condition The end 52 of the belt loop element 36 and the protruding portion 48 of the fastener are free to rotate within the pocket 56 to the extent permitted by the width of the detached lower edge 68 of the outer layer/panel 58. In the current embodiment, the width of the detached lower edge of the outer layer/panel is sufficient to permit 20° of clockwise and counterclockwise rotation from vertical. This allows the holster 10 to be positioned at different spots about the waistband 24 of the wearer 20, allowing the holster to be worn at different angles. For example, the holster can be worn at the 4 o'clock position with a forward tilt, or at the 11 o'clock position with a cross draw tilt, or in the 1 o'clock position in the appendix area in a slight rearward tilt. In the context of the specification, the terms "4 o'clock position," "11 o'clock position," and "1 o'clock position" are defined by the following clock positions: "12 o'clock position" is at the wearer's navel, "3 o'clock position" is the wearer's right side hip, "6 o'clock position" is directly over the wearer's buttocks center, and "9 o'clock position" is the wearer's left hip.

While a current embodiment of a holster has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holster comprising:

a body defining a pistol receptacle;

the body having a medially-facing first major surface configured to face toward a wearer and a laterally-facing second major surface configured to face away from the wearer;

a first belt passage associated with the first major surface and adapted to receive a wearer's belt;

a belt loop receptacle associated with the second major surface;

a belt loop element configured to be removably received by the belt loop receptacle;

the belt loop element including a fastener having a fastened condition and an unfastened condition; and the fastener adapted to secure the belt loop element in a closed loop when in the fastened condition to encompass a wearer's belt with the body between the belt and the wearer, and to enable insertion and removal of a belt when in an unfastened condition.

2. The holster of claim 1 including a pair of first belt apertures spaced apart from each other.

3. The holster of claim 2 wherein each of the first belt apertures is proximate to one of a pair of opposed peripheral edges of the body.

4. The holster of claim 1 wherein the fastener has two opposed portions selectably connectable to each other.

5. The holster of claim 4 wherein belt loop element is an elongated body and the fastener portions are on opposed ends of the belt loop element.

6. The holster of claim 1 wherein the belt loop receptacle includes a pocket in which one end of the belt loop element is inserted.

7. The holster of claim 6 wherein the pocket is defined by an outer layer defining a belt loop element fastener aperture.

8. The holster of claim 7 wherein the belt loop element fastener aperture is configured to enable the opposed fastener portions to connect to each other via the belt loop element fastener aperture.

9. The holster of claim 7 wherein the fastener included a protruding portion protruding above a surface of the belt loop element, and wherein the protruding portion when received in the belt loop element fastener aperture resists removal of the belt loop element from the pocket.

10. The holster of claim 6 wherein the pocket is defined by a panel overlaying and attached to the second major surface.

11. The holster of claim 10 wherein the panel is attached to the second major surface at opposed side edges of the panel, and is detached from the second major surface at a lower edge to provide access to the pocket.

12. The holster of claim 11 wherein the panel is attached at its entire periphery except for the lower edge.

13. The holster of claim 7 wherein the fastener is a snap.

* * * * *